US006325342B1

(12) United States Patent
Dignat

(10) Patent No.: US 6,325,342 B1
(45) Date of Patent: Dec. 4, 2001

(54) ERGONOMIC TYPIST VERTEBRAL SUPPORT

(76) Inventor: Jean-Francois Dignat, 200 Avenue du Pere Prevost, Montpellier 34090 (FR)

( * ) Notice: Subject to any disclaimer, the term of this patent is extended or adjusted under 35 U.S.C. 154(b) by 0 days.

(21) Appl. No.: 09/525,961

(22) Filed: Mar. 15, 2000

(30) Foreign Application Priority Data

Mar. 22, 1999 (FR) ..... 9903634
Jan. 17, 2000 (FR) ..... 0000534

(51) Int. Cl.[7] ..... B68K 5/00

(52) U.S. Cl. ..... 248/118; 248/118.3; 248/918; 248/285.1

(58) Field of Search ..... 248/118.1, 118.3, 248/118, 918, 118.5, 125.8, 188.1, 188.2, 188.4, 188.5, 286.1, 287.1, 278.1, 281.11, 283.1, 295.11; 297/353

(56) References Cited

U.S. PATENT DOCUMENTS

| | | | | |
|---|---|---|---|---|
| 4,482,063 | | 11/1984 | Berke et al. | 211/69.1 |
| 5,037,054 | * | 8/1991 | McConnell | 248/284 |
| 5,104,073 | | 4/1992 | Van Beek et al. | 248/118 |
| 5,211,367 | * | 5/1993 | Musculus | 248/279 |
| 5,342,006 | | 8/1994 | Tice | 248/118 |
| 5,402,972 | | 4/1995 | Schmidt | 248/118 |
| 5,407,249 | * | 4/1995 | Bonutti | 297/411.35 |
| 5,462,247 | * | 10/1995 | Aldrich | 248/118 |
| 5,465,931 | * | 11/1995 | MacDonald | 248/118.3 |
| 5,564,667 | * | 10/1996 | Copeland et al. | 248/278.1 |
| 5,566,915 | * | 10/1996 | Hansare | 248/188.8 |
| 6,042,064 | * | 3/2000 | Hong | 248/118.5 |

FOREIGN PATENT DOCUMENTS

| | | | |
|---|---|---|---|
| 2203265 | 8/1973 | (DE) . | |
| 8433867A1 | 6/1991 | (EP) | A47B/21/03 |
| 2249053A | 4/1992 | (GB) | B41J/29/00 |

* cited by examiner

*Primary Examiner*—Ramon O. Ramirez
*Assistant Examiner*—Tan Le
(74) *Attorney, Agent, or Firm*—Henri J. A. Charmasson; John D. Buchaca

(57) ABSTRACT

Vertebral strain relief is provided to a keyboard or other data input device operator by a support device attached to the desktop or other data input device-holding structure and projects obliquely and upwardly under the forearms and elbows of the operator to create the same type of upper body support provided by the arms of an armchair. The support structure comprises a pair of telescopic tubular members which provides for height and distance adjustment of the support member as well as its placement, in stowed position, in level contact with the edge of the working surface.

10 Claims, 2 Drawing Sheets

ERGONOMIC TYPIST VERTEBRAL SUPPORT

FIELD OF THE INVENTION

This invention relates to office equipment such as desks and computer work stations, and more particularly to good-posture maintaining devices and upper body supports for persons sitting at a desk or work station and operating a keyboard, mouse or other data entry instrument.

BACKGROUND OF THE INVENTION

Typist and computer operators who spend long hours sitting at a desk or work station operating a keyboard, mouse, input pad or other manipulable data entry instrument are subject to neuromyalgic traumas such as cervical, dorsal and cervico-brachial neuralgia. Persons already affected by arthritis, kyphotic or scoliosic disorders are often unable to withstand long periods of work sitting at a desk or work station. The above-described pathological phenomena are due to both the gravitational pull of the arms upon the scapular girdle, and bad posture imposed by faulty seat and improper height setting of the seat or work surface.

The prior art already offers devices designed to avoid or relieve carpo tunnel syndrome, tendinitis and other hand and wrist pathological conditions. Exemplary embodiments of such devices are disclosed in: U.S. Pat. No. 4,482,063 Berke et al., EPO Application No. 90123968.1 Edtech Co., British Application NO. 2,249,053A Ledesma; and U.S. Pat. No. 5,402,972 Schmidt. Those embodiments are not configured to support the upper body and relieve or avoid any spinal, scapular or brachial traumas, but are strictly intended, shaped and dimensioned to support the wrists or the distal portions of the user's forearm providing no convenient support surfaces for the elbows or proximal portions of the forearms against which the weight of the upper body could come to bear. The instant inventor is believed to be the first to identify the mechanical causes of the upper body neuromyalgic syndromes and to devise an effective remedial solution.

SUMMARY OF THE INVENTION

The principal and secondary objects of this invention are to avoid or relieve neuromyalgic traumas of the spine and shoulders, caused by long periods of sitting at a desk or work station while operating a keyboard, mouse, input pad or other manipulable data entry instrument, by providing a convenient comfortable and effective support of the scapular girdle and spine through the upper arms.

These and other valuable objects are achieved by the device that places pads or support bars in supporting contact with the elbows and proximal end sections of the operator's forearms nearest the elbows. The support member comprises a pair of telescopic segments which are cantilevered from a support bracket attached under the desktop structure. The height and distance of the support member from the desktop structure is adjusted by axial movement of one of the telescopic segments and, in an alternate embodiment, by pivotal movement of the arm.

DESCRIPTION OF THE PREFERRED EMBODIMENT OF THE INVENTION

Figure 1:
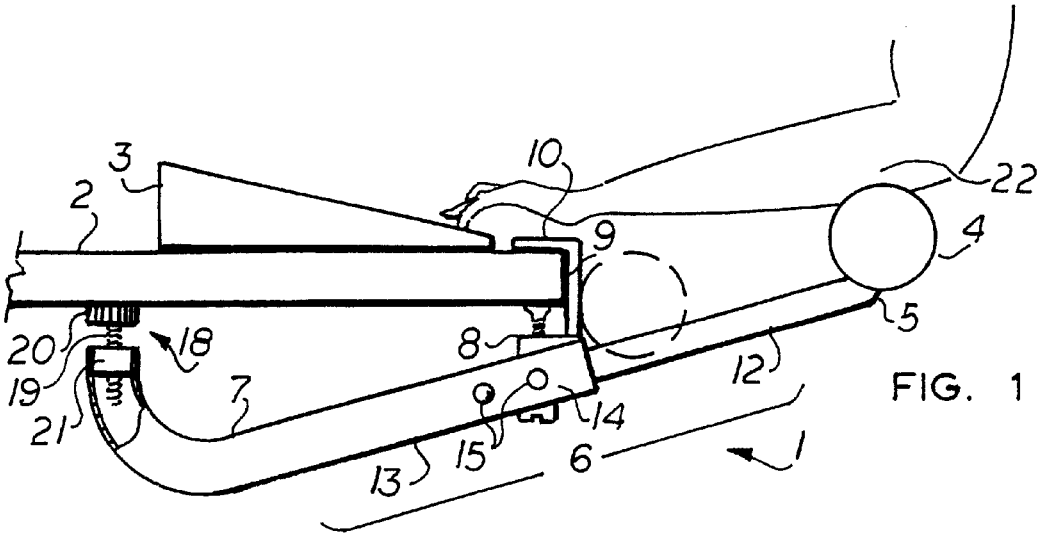
FIG. 1 is a side view of a vertebral support device according to the invention.

Referring now to the drawing there is shown in FIG. 1–4 a first embodiment of a vertebral strain relief device 1 according to the invention. The device is designed to be fitted to a work bench or desktop structure 2 or any other similar structure designed to hold a keyboard 3, mouse or other type of manipulable data input instrument.

The device comprises a padded forearm support member or pad 4 mounted at the proximal end section 5 of a lever 6 whose distal end section 7 extends under the desktop structure 2. The lever is supported by a bearing bracket 8 near the proximate edge 9 of the desktop surface 2. The bearing bracket 8, more specifically illustrated in FIG. 4, comprises a C-clamp 10 shaped and dimensioned to engage over the edge 9 of the desktop surface including a tightening screw 11. The lever 6 is made of two telescopically engaged tubular segments 12 and 13. The proximal segment 12 comprises the proximal end section 5 which is secured to the arm support 4. It is axially and adjustably engaged into the distal segment 13. The proximal segment can be adjustably set into the distal one at a plurality of discrete positions determined by a pressure-sensitive nib and hole mechanism 14 more specifically illustrated in FIG. 3. A series of holes 15 in the wall of the distal segment 13 are shaped and dimensioned to be engaged by a nib 16 protruding from the wall of the proximal segment 12. The nib 16 is biased outwardly by a leaf-spring 17 mounted inside the proximal segment. The distal end section 7 of the distal segment 13 is fitted with an adjustable spacer mechanism 18 oriented toward the undersurface of the desktop structure 2. Basically, the spacer mechanism consists of a screw 19 having a knurled head 20 bearing against the underside of the desktop structure and a threaded stem engaged into a nut 21 mounted in the lumen opening of the distal end section 7. The proximal segment 12 is dimensioned to bring the support member 4 in supporting contact with the elbow or proximal portion 22 of the user's forearm when fully or near fully extended. When the proximal segment 12 is fully engaged into the distal segment 13, the support member 4 is brought down into a position flush and level with the edge 9 of the desktop structure 2 as illustrated in dotted line in FIG. 1.

Figure 2:
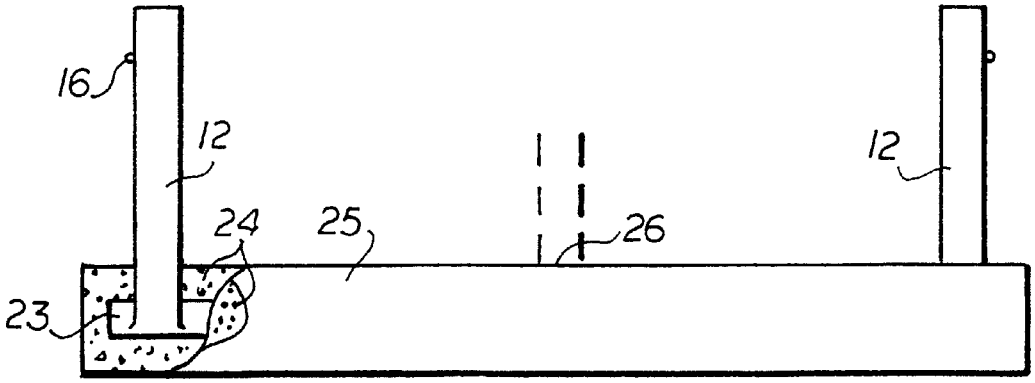
FIG. 2 is bottom plan view of the support bar.
Figure 4:
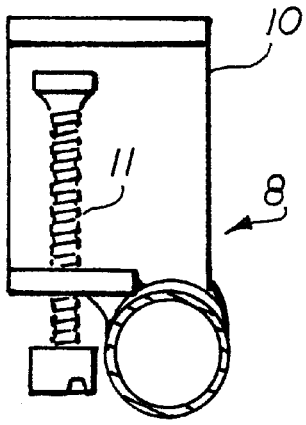
FIG. 4 is a front view of the bearing bracket.
Figure 3:
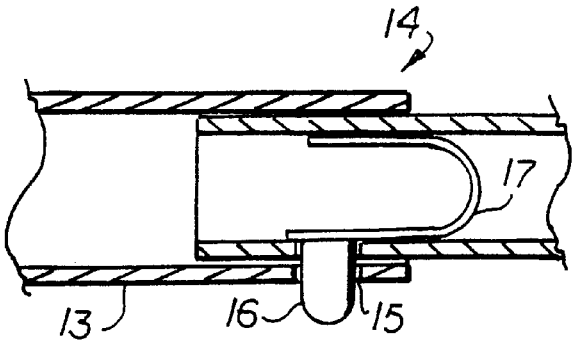
FIG. 3 is a detail cross-sectional view of the axial adjustment mechanism.

Typically, the device comprises two lever structures positioned astride the user and joined by a common support member more specifically illustrated in FIG. 2. It should be understood that two lever structures could be used, each fitted with their own separate independent support member. The common support member comprises a bar 23 attached at either end to the proximal end section 5 of the proximal segments 12. The support member 4 is padded by a layer of synthetic foam material 24 covered with a synthetic skin 25. Alternately, a single lever structure could be used connected to a median portion 26 of the bar as shown in dotted line in FIG. 2.

Figure 5:
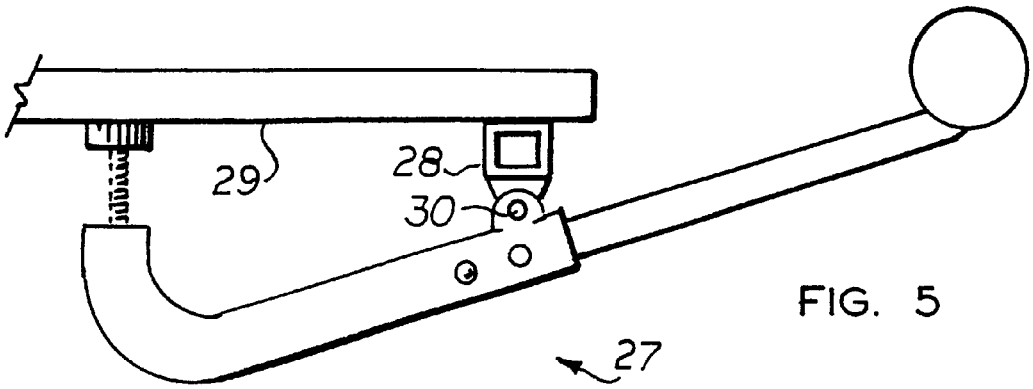
FIG. 5 is a side view of a first alternate embodiment of the invention.

In a first alternate embodiment 27 of the invention as illustrated in FIG. 5, the attachment of the bearing bracket 28 to the desktop undersurface is accomplished by gluing or screwing in a permanent or semi-permanent manner to the undersurface 29 of the desktop structure. Moreover, the bracket comprises a pivot point forming a fulcrum for the lever structure about a horizontal axis 30 substantially parallel to the proximal edge 9 of the desktop structure.

Figure 6:
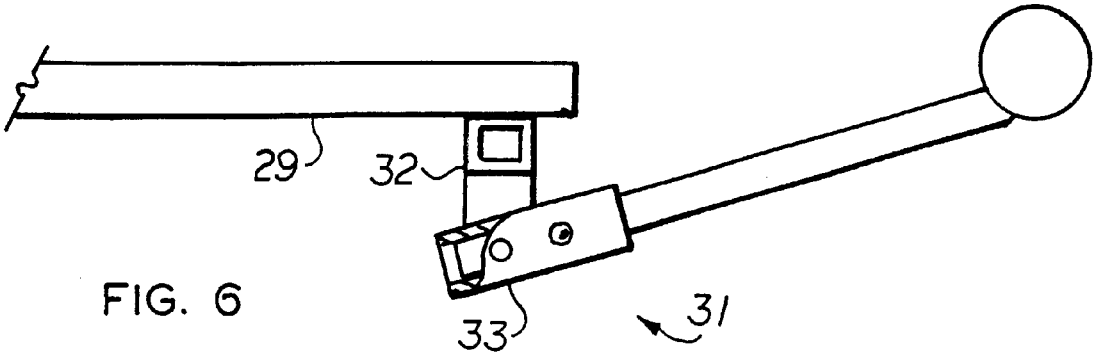
FIG. 6 is a side view of a second alternate embodiment of the invention.

In a second alternate embodiment 31 of the invention illustrated in FIG. 6, the bearing bracket comprises a sturdy attachment 32 to the undersurface 29 of the desktop structure, and the distal segment of the lever is reduced to a short section 33 that does not extend distally under the desktop structure.

Figure 7:
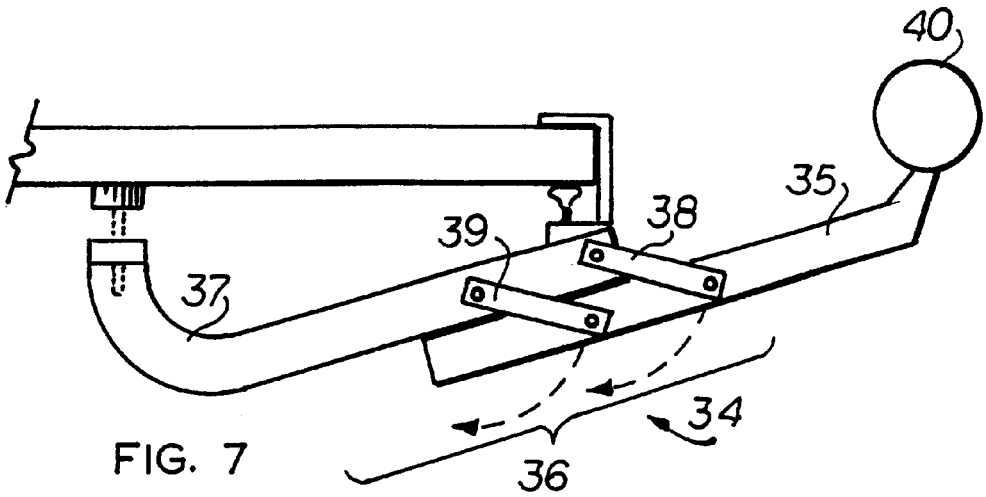
FIG. 7 is a side view of a third alternate embodiment of the invention.

In the third embodiment of the invention 34 illustrated in FIG. 7, the proximal segment 35 of the lever 36 is secured to the distal segment 37 by a parallelogrammic linkage mechanism. The mechanism consists of two pairs of parallel swing plates 38, 39 rotatively attached at opposite ends to the two lever segments. The mechanism allows the swinging translation of the proximal segment 35 from the operating position illustrated in the drawing to a stowed position under the work surface.

It should be understood that the features of the above-described embodiments can be shared among them to match the particular geometry of the desktop structure and the anatomy of the user.

While the preferred embodiments of the invention have been described, modifications can be made and other embodiments may be devised without departing from the spirit of the invention and the scope of the appended claims

What is claimed is:

1. The combination of a manipulable data input instrument and its supporting structure having an undersurface with a device attached to said undersurface and positioned to provide vertebral strain relief to an operator of said instrument by supporting a proximal portion of at least one of said operator's forearms, said device comprising:

a support member shaped and dimensioned to supportively contact said proximal portion when said operator operates said instrument;

means for adjustably setting the height and distance of said support member in relation to said structure.

wherein said support member comprises an arm resting pad, a lever fixedly secured about a median portion to said undersurface, said lever having a segment mounting said pad and extending from said median section in an oblique and upward direction to place said pad under said proximal portion; and wherein said segment including first and second sections connected to allow axial length adjustment of said segment.

2. The device of claim 1, wherein said lever comprises:

a proximal segment mounting said pad;

a distal segment secured to said undersurface; and a parallelogrammic linkage mechanism between said proximal and distal segments, to swingingly translate the proximal segment from an extended operation position to a stowed position under said undersurface.

3. A device attached to the undersurface of a structure holding a manipulable data input instrument, and designed to provide vertebral strain relief to an operator of said instrument by supporting a proximal portion of at least one of said operator's forearms, said device comprising:

a support member shaped, dimensioned and positioned to supportively contact said proximal portion when said operator operates said instrument;

means for adjustably setting the height and distance of said support member in relation to said structure;

wherein said support member comprises an arm resting pad, a lever secured about a median portion to said undersurface, said lever having a segment mounting said pad;

said segment including first and second sections connected to allow axial length adjustment of said segment; and wherein said means for adjustably setting further comprise:

said lever having a proximal end, a distal end and a median fulcrum point;

means for rotatively securing said fulcrum point to said undersurface about a horizontal first axis;

said first section being connected to said means for securing, and said second section being attached to said pad;

means for adjustably locking the rotational orientation of said lever about said fulcrum point;

whereby the distance of said member from said structure can be set by axial adjustment of said sections in relation to each other, and the height of said pad can be set by rotational adjustment of said lever about said axis.

4. The device of claim 3, wherein said means for adjustably locking said orientation comprise a variable-length spacer between said distal end of the lever and said undersurface.

5. The device of claim 4, wherein said means for rotatively securing comprise a bearing bracket attached to said structure.

6. The device of claim 3, wherein said device is shaped, dimensioned and positioned to bring said pad in level contact with said structure in a stowed position.

7. A structure for supporting the proximal part of a person's forearm while said person is working on a desktop, said structure comprising:

a support bracket attached proximate an edge of said desktop nearest said person;

a lever secured to said bracket, wherein a distal segment of said lever extends obliquely beyond said support bracket and under said desktop, and a proximal segment of said lever extends obliquely and upwardly ahead of said bracket toward said person;

and extension rod projecting axially and adjustably from said proximal segment toward said person;

said extension rod having minimum and maximum extension positions;

a support member mounted at a proximal end section of said extension rod, said support member being shaped and oriented to supportively contact said proximal part of the person's forearm; and an adjustable spacer mounted on a distal section of said distal segment, said spacer being oriented to contact said desktop.

8. The device of claim 7, wherein said lever is positioned and dimensioned to bring said support in contact with said desktop edge when said extension rod is at its minimum extension position.

9. The device of claim 7, wherein said bearing bracket comprises a clamp shaped and dimensioned to securably engage upon said desktop edge.

10. The device of claim 7, wherein said bearing bracket comprises an attachment to an undersurface of said desktop.

* * * * *